United States Patent [19]

Anthon et al.

[11] 4,310,784

[45] Jan. 12, 1982

[54] CATHODE RAY TUBE FACE PLATE CONSTRUCTION FOR SUPPRESSING THE HALO AND METHOD

[76] Inventors: Erik W. Anthon, 1487 Manzanita Ave., Santa Rosa, Calif. 95404; Carol Jacobs, P.O. Box 2383, Santa Rosa, Calif. 95405

[21] Appl. No.: 36,324

[22] Filed: May 7, 1979

[51] Int. Cl.[3] ..... H01J 29/18; H01J 29/89

[52] U.S. Cl. ..... 313/474; 313/478

[58] Field of Search ..... 313/462, 466, 474, 478, 313/477 R, 479

[56] References Cited

U.S. PATENT DOCUMENTS

| | | | |
|---|---|---|---|
| 2,476,619 | 7/1949 | Nicoll | 3 13/474 X |
| 2,599,739 | 6/1952 | Barnes | 313/478 X |
| 2,676,109 | 4/1954 | Barnes et al. | 313/477 X |
| 3,185,020 | 5/1965 | Thelen . | |
| 3,504,212 | 3/1970 | Wollentin et al. | 313/474 |
| 3,573,529 | 4/1971 | Tomii | 313/478 |

*Primary Examiner*—Palmer C. Demeo

*Attorney, Agent, or Firm*—Flehr, Hohbach, Test, Albritton & Herbert

[57] ABSTRACT

Cathode ray tube face plate construction for suppressing the halo on the cathode ray tube having a face plate formed of glass with an index of refraction in the vicinity of 1.52 and with outside and inside surfaces. A fluorescent phosphor screen is carried by the inside surface. An optional metallic coating overlies the phosphor screen on the side of the screen facing away from the face plate. An anti-reflection coating is carried by the outside surface of the face plate for reducing reflection from the outside surface of the face plate to suppress the central portion of the halo. A thin film interference coating is carried by the inside surface of the face plate for suppressing the outer ring-like portion of the halo. It is disposed between the phosphor screen and the inside surface of the face plate. The thin film interference coating has high transmittance for light emitted by the phosphor at near normal of incidence and high reflectance at high angle of incidence.

6 Claims, 7 Drawing Figures

CATHODE RAY TUBE FACE PLATE CONSTRUCTION FOR SUPPRESSING THE HALO AND METHOD

Many cathode ray tubes used in oscilloscopes and other displays suffer from the formation of a halo surrounding the illuminated spot on the screen. In such cathode ray tubes, an electron beam strikes a small spot on the flourescent phosphor screen which covers the inside surface of the face plate of the cathode ray tube. The grains of phosphor that are struck by the electron beam emit visible light which makes it possible for the observer or camera placed in front of the cathode ray tube to follow the motion of the electron beam and to read the display on the screen. The phosphor grains which form the screen emit light in all directions forward, backward and to all sides, only a small portion of the light emitted in the forward direction can be utilized by the observer. The back side of the phosphor screen is optionally covered with a metallic coating such as aluminum which is used to protect the screen against bombardment by negative ions which cannot penetrate the metallic layer while the electrons of the electron beam readily penetrate the metallic coating. In addition, the metallic coating will also reflect much of the light emitted in the backward direction from the phosphor grains and direct it forward through the phosphor screen, thus increasing the brightness of the display. The light emitted towards the sides of the phosphor grains is mostly lost, but some of it may cause formation of an undesirable halo surrounding the activated spot. The halo is caused by light reflected back from the outside surface of the face plate illuminating the phosphor screen at a distance away from the activated spot. The halo typically is a nearly uniformly illuminated area with a clearly defined outer edge around the bright spot on the screen. The diameter of the halo typically is 3.5 times the thickness of the glass, where the glass has an index of approximately 1.52 , of the face plate. In this connection is should be noted that the phosphor screen is not in full optical contact with the face plate, but is merely adhering to it at many small points of contact. It has been found that the halo is not reduced by the use of filters normally placed in front of cathode ray tubes for the purpose of contrast enhancement. In fact, the visibility of the halo is actually enhanced by such filters. There is, therefore, a continuing need to suppress the halos on cathode ray tubes.

The cathode ray tube face plate construction for suppressing the halo on the cathode ray tube consists of a face plate formed of clear glass having outside and inner surfaces with a fluorescent phosphor screen carried by the inside surface and an optional metallic coating overlying the phosphor screen on the side of the screen facing away from the face plate. An antireflection coating is carried by the outside surface of the face plate to reduce reflection from the outside surface of the face plate to suppress the central portion of the halo. An angle sensitive thin film interference coating is carried by the inside surface of the face plate for suppressing the outer ring-like portion of the halo and is disposed between the phosphor screen and the inside surface of the face plate. The thin film interference coating has high transmittance for light emitted by the phosphor at low angles of incidence and high reflectance for light emitted by the phosphor at high angles of incidence.

In general, it is an object of the present invention to provide a cathode ray tube face plate construction and method in which the halo is suppressed.

Another object of the invention is to provide a construction and method of the above character in which the halo is suppressed by the use of coatings carried by the surfaces of the face plate.

Another object of the invention is to provide a construction and method of the above character in which the intensity of the halo is substantially reduced and in which the brightness of the display is increased.

Another object of the invention is to provide a construction and method of the above character in which contrast enhancement filters can be utilized to result in displays with more contrast and less sensitivity to ambient light.

Another object of the invention is to provide a construction and method of the above character in which the halo is suppressed without reducing the brightness of the display.

Another object of the invention is to provide a construction of the above character in which there is reduced ambient illumination of the phosphor.

Additional objects and features of the invention will appear from the following description of the preferred embodiment as set forth in detail in conjunction with the accompanying drawings.

Figure 1:
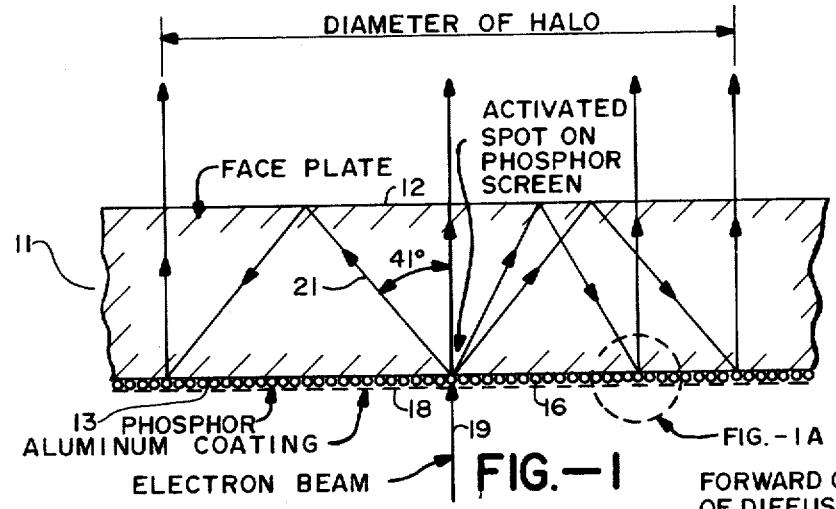
FIG.—1 PRIOR ART
FIG. 1 is a cross sectional view of a portion of a face plate of a cathode ray tube showing the manner in which a halo is formed on a cathode ray tube.

In order to understand the present invention, it is necessary to understand the mechanism in the face plate of the cathode ray tube which causes the formation of a halo. A portion of the face plate 11 of a typical cathode ray tube which is utilized in oscilloscopes and other display devices is shown in FIG. 1. The face plate on a typical cathode ray tube is formed of clear glass. It is provided with an outside or front surface 12 and inside or back surface 13. The surfaces 12 and 13 typically are generally substantially planar and parallel to each other. A phosphor screen 16 is carried by the inside surface 13 of the face plate and is formed of a multitude of phosphor grains 17 which fluoresce or or emit light when struck by an electron beam. An optical metallic coating 18 formed of a suitable material such as aluminum is coated on the rear or back side of the phosphor screen 16 to protect the phosphor screen against bombardment by negative ions. The negative ions cannot penetrate the aluminum coating whereas the electrons from the electron beam can readily penetrate the aluminum and strike the phosphor grains to cause them to fluoresce. The electron beam 19 is generated by an electron gun provided on the cathode ray tube in a manner well known to those skilled in the art and is swept back and forth across the screen to create an image on the screen. As pointed out previously, the phosphor grains are not in full optical contact with the inside surface of the face plate but merely adhere to it at small points of contact.

The steepest angle inside the glass indicated by the arrows 21 at which light rays emitted from the phosphor can enter and leave the face plate without optical contact with the face plate is approximately 41° from a line perpendicular to the face plate assuming that the glass face plate has an index refraction of 1.52. Light rays with a steeper angle than that are trapped within the face plate. The 41° limit defines the outside diameter of the halo to be 3.5 times the thickness of the glass face plate.

The relative intensity of the halo can be calculated from the values of reflection and transmission at the surfaces of the face plate at different incidence angles. The calculation must be carried out separately for the S and P polarization of the light and the average resultant value is used. The intensity of the halo is a function of the diameter and is plotted and shown as curve 26 in FIG. 3. The halo is a nearly uniformly illuminated area with a clearly defined outer edge around the bright spot on the screen. As pointed out above the diameter of the halo is typically 3.5 times the thickness of the glass between the index of 1.52 of the face plate.

The phosphor grains 17 when struck by an electron beam emit light in all directions, forward, backward and to all sides. Only the small part of the light emitted in the forward direction near normal incidence can be utilized. As illustrated in FIG. 1 when a phosphor grain is struck by an electron beam it forms an activated spot in the phosphor screen and emits light in all directions.

Figure 1A:
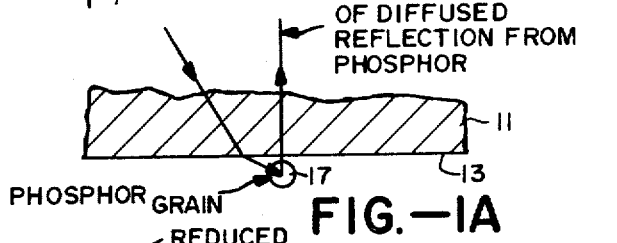
FIG. 1A is an enlarged cross sectional view of a portion of the view shown in FIG. 1.

In FIG. 1A, there is shown in large detail the action of the phosphor grain when it is illuminated by a reflected light ray from the first or front surface 12 of the face plate 11 to cause the undesired halo hereinbefore described.

Figure 2:
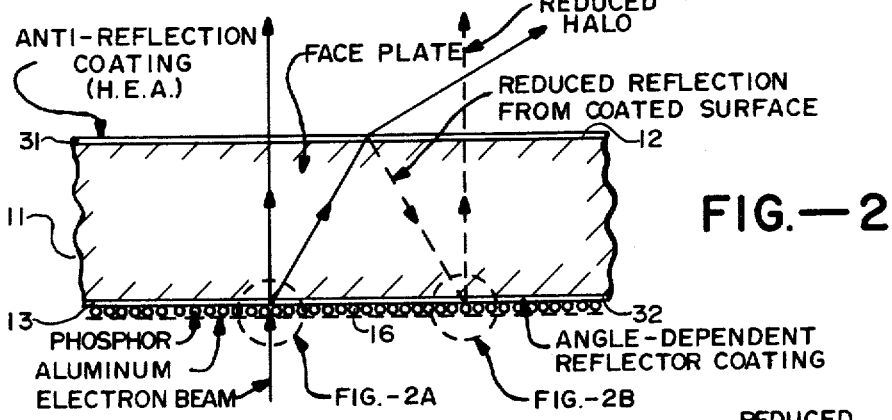
FIG. 2 is a cross sectional view of a face plate construction incorporating the present invention.

A face plate incorporating the present invention is shown in FIG. 2 and as shown therein the face plate 11 is formed of glass having outside and inside surfaces 12 and 13. A multi-layer anti-reflection coating 31 is formed on the outside surface 12. The anti-reflection coating 12 may be of the type described in U.S. Pat. No. 3,185,020.

By way of example, the anti-reflection coating 31 on the front surface can have the following design:

| Medium n = 1.0 | | |
|---|---|---|
| Layer | Index | Phys. Thick (nm) |
| 1 | L | 57.7 |
| 2 | H | 59.7 |
| 3 | L | 131.0 |
| 4 | H | 50.6 |
| 5 | L | 146.4 |
| 6 | H | 59.6 |
| Substrate n = 1.52 | | |

The low index layers were formed of silicon oxide ($SiO_2$) and having an index of refraction of approximately 1.45 and the high index layers were formed of titanium dioxide ($TiO_2$) having an index of refraction of approximately 2.5.

A multi-layer interference coating 32 is deposited upon and carried by the inside or back surface 13. The coating 32 is a non-absorbing coating comprised of stack of alternating high and low index dielectric materials. The coating 32 is designed so that it is angle sensitive as hereinafter described. One coating found to have a satisfactory design is set forth below:

| Medium n = 1.0 | | |
|---|---|---|
| Layer | Index | Phys, Thick (nm) |
| 1 | L | 124.1 |
| 2 | H | 30.1 |
| 3 | L | 21.3 |
| 4 | H | 157.3 |
| 5 | L | 29.4 |
| 6 | H | 19.9 |
| Substrate n = 1.52 | | |

The low index layers that were formed of silicon dioxide ($SiO_2$) having an index refraction of approximately 1.45 and the high index layers were formed of titanium dioxide ($TiO_2$) having an index refraction of approximately 2.5. It should be appreciated that in the above design the high and low index layers can be formed of different materials. The materials utilized for the low index layers should have an index of refraction ranging from 1.30 to 1.7 and the materials for the high index layer should have an index of refraction ranging from 1.8 to 2.5. As shown in FIG. 2, the phosphor screen 16 is then placed over the angle sensitive interference coating 32 and the metallic coating 18 is placed over the phosphor screen.

The reflection from the front or side surface 12 obtained by application of the anti-reflection coating 31 reduces the halo by reducing the reflection from the front surface to effectively suppress the central portion of the halo. This can be seen from the curve 36 shown on the left hand side of FIG. 3. The anti-reflecting coating 31 is quite effective at limited angles but no anti-reflection coating will work at incident angles near the total internal reflectance angle and the outer part of the halo will therefore remain unchanged. The effect will be that the halo is changed from a nearly uniformly illuminated disc to a sharply defined ring which is equally objectionable.

Figure 4:
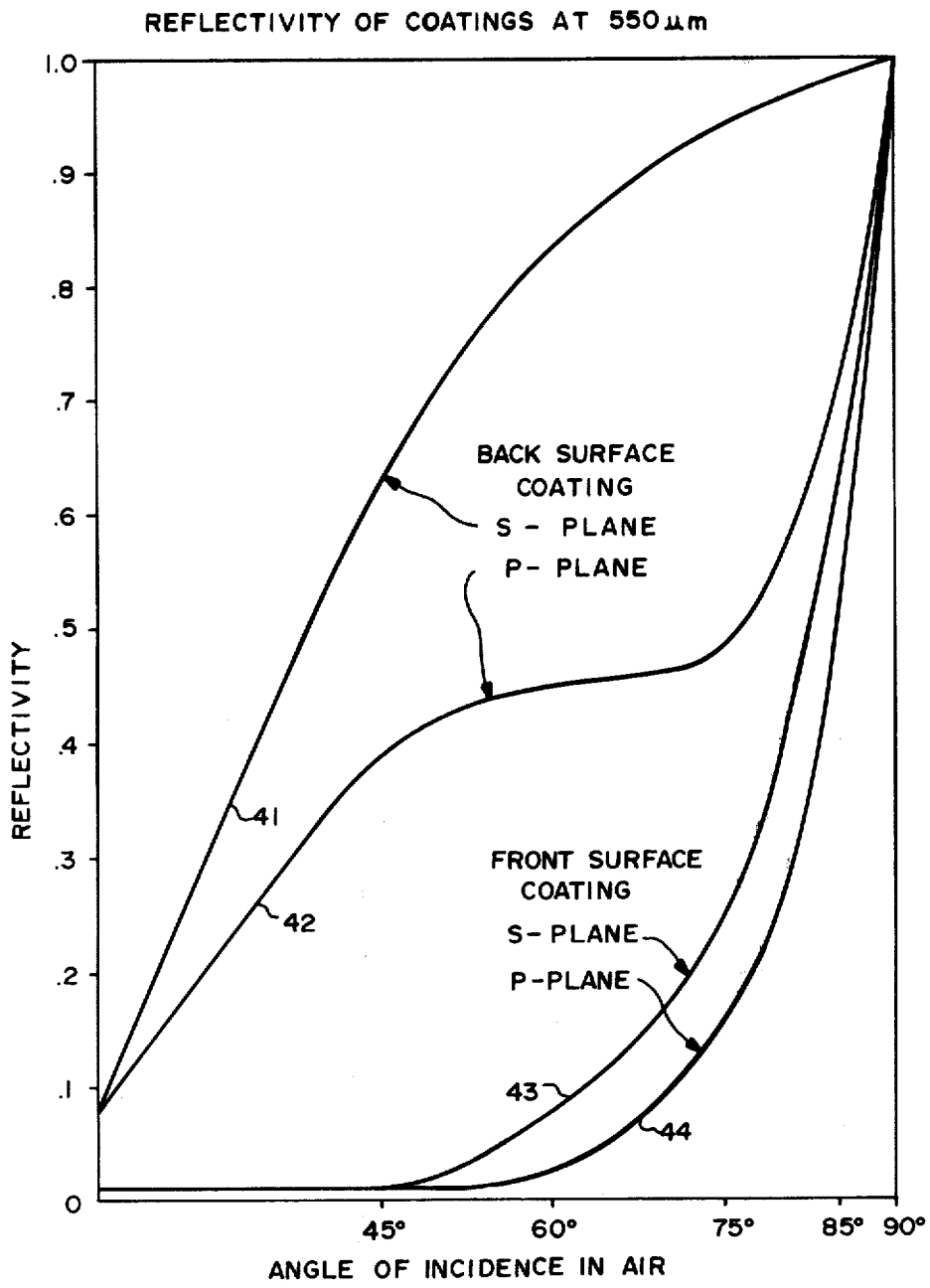
FIG. 4 is a graph showing the reflectivity of the coating utilized on the face plate for various angles of incidence at 550 nanometers.

The angle sensitive interference coating 32 is utilized to suppress the ring halo which remains after the anti-reflection coating 31 is placed on the front or outside surface 12. The angle sensitive coating 32 is designed to take advantage of the shift towards shorter wavelengths with increasing incidence angles which is common to all interference type thin film coatings. In addition, the coating is designed to take advantage of the fact that the light emitted by the phosphor screen 16 will generally represent a relatively narrow spectral range normally 500 to 600 nanometers. The coating 32 is designed to have low reflectance of the light emitted by the phosphor at low angle of incidence and high reflectance at high angles of incidence. The reflectance of the angle sensitive coating 32 for various angles of incidence at 550 nanometers is shown on FIG. 4 where curves 41 and 42 are for the S plane and P plane of polarization respectively of the back surface coating 32 and the curves 43 and 44 are for the S plane and P plane of the front surface coating 31. The angles of incidence shown are as defined in air.

Figure 2A:
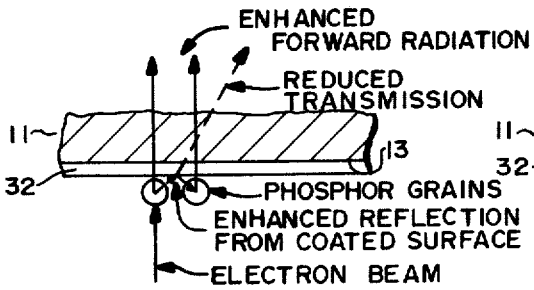
FIG. 2A is an enlarged cross sectional view of a portion of the view shown in FIG. 2.
Figure 2B:
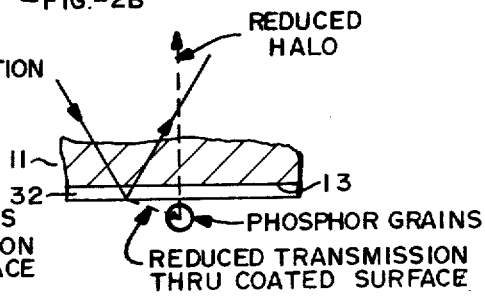
FIG. 2B is an enlarged cross sectional view of another portion of the view as shown in FIG. 2.

The back surface coating 32 suppresses the ring halo by stopping the rays from the phosphor screen from entering and leaving the glass face plate 11 at steep incidence angles. This can be seen from FIGS. 2A and 2B. FIG. 2A shows that the coating is designed for low reflectance and high transmission at the dominant wavelength of the phosphor and will not reduce the useful part of light emitted by the phosphor at a near normal angle but will reflect light emitted at a high angle to provide reduced transmission of the high angle light. As shown in FIG. 2B light reflected back from the front surface 12 has reduced transmission through the coating 32 and therefore there will be a reduced forward component of diffuse reflection from the phosphor. The coating 32 thus will effectively suppress the ring halo caused by rays with incidence angles $<45°$ but will have little effect on the cental part of the halo. It is for this reason that the coating 32 is utilized with the anti-reflection coating 31 which effectively suppresses the central portion of the halo.

Figure 3:
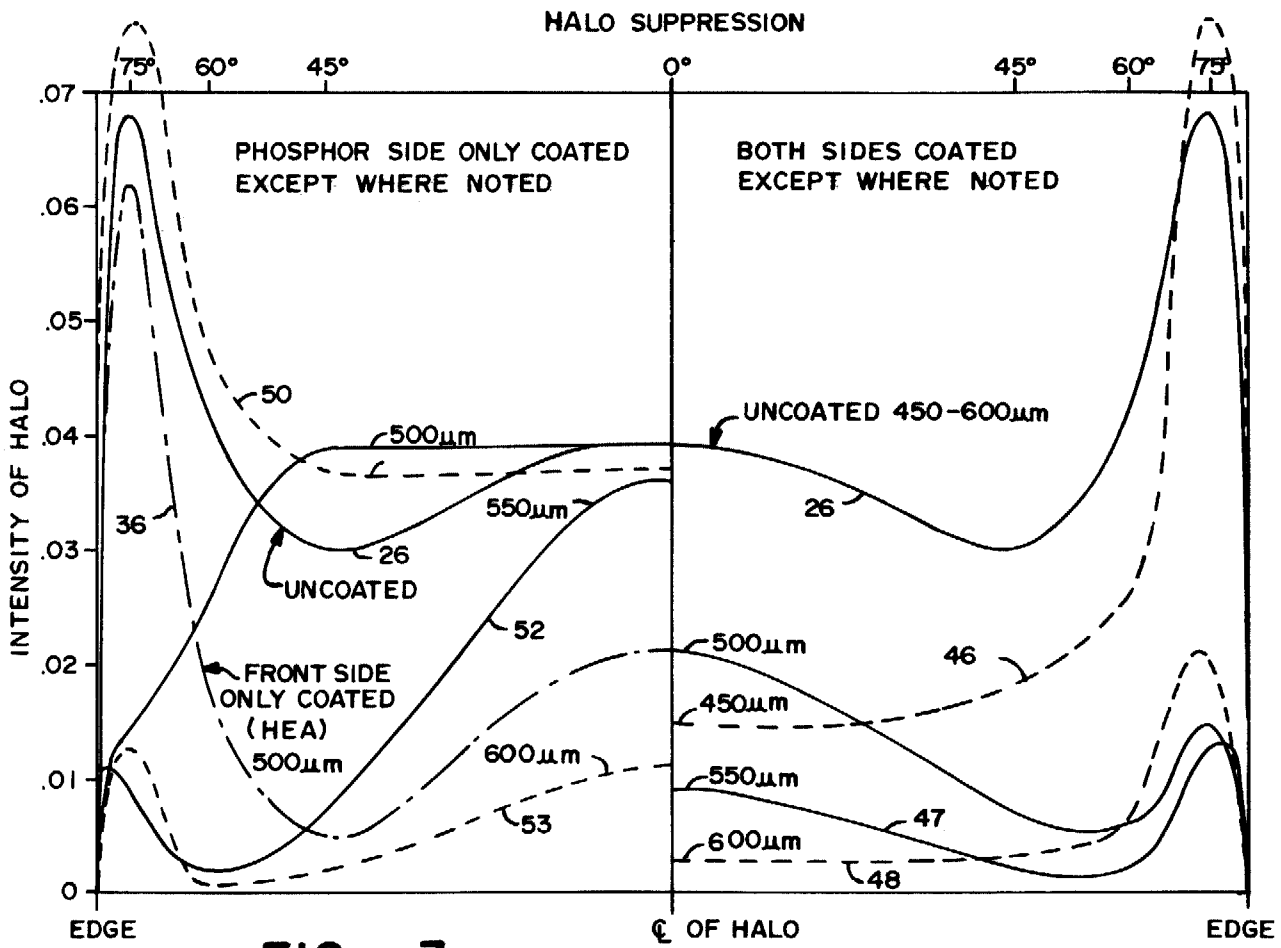
FIG. 3 is a graph showing the intensity of the halo as a function of diameter and the suppresion of the halo by a non-absorbing coating.

The ability of the coating 32 to suppress the halo is shown in FIG. 3 both alone and in connection with the anti-reflection coating on the front surface. As shown in FIG. 3, the left hand side represents the results when only the phosphor side or back side is coated except where noted whereas the right hand side represents the results when both sides, the front and back, are coated except where noted. The amount of halo suppression with both sides coated at 500 nanometers is shown by the curve 46, at 550 nanometers is shown by the curve 47 and at 600 nanometers is shown by the curve 48. The suppression obtained by the coating 32 when it only is used is shown on the left hand side with curve 51 being for 500 nanometers, curve 52 for 550 nanometers and curve 53 for 600 nanometers.

As pointed out previously, some of the light which is emitted from the phosphor grains is emitted towards the sides. Some of this light will reach the face plate 11 at high angles of incidence and will be reflected directly back by the coating 32 at the phosphor which reflects it diffusely in the forward direction. This is additional light which without the coating would have been lost or would have contributed to the halo. Thus, it can be seen that the coating traps this light and contributes to the increased brightness of the display.

The coating 32 applied to the back surface of the face plate 11 will tend to have a higher specular reflection than the uncoated face plate. The coated face plate will, on the other hand, admit less ambient light to the phosphor screen. This specular reflection can be effectively suppressed by the use of a circularly polarizing filter. The reduced ambient illumination of the phosphor together with the increased brightness of the display produced by the coating makes possible the design of high contrast displays usable in high ambient light.

It is apparent from the foregoing that a non-absorbing coating can be used to suppress the halo on cathode ray tubes without reducing the brightness of the display. In addition, the coatings offer the possibility of increase of brightness of the display and reduced ambient illumination of the phosphor.

What is claimed is:

1. In a cathode ray tube face plate construction for suppressing the halo on the cathode ray tube, a face plate formed of glass having outside and inside surfaces, a fluorescent phosphor screen carried by the inside surface and an anti-reflection coating carried by the outside surface of the face plate to reduce reflection from the outside surface of the face plate to suppress the central portion of the halo and an angle sensitive interference coating carried by the inside surface of the face plate for suppressing the outer ring-like portion of the halo and being disposed between the phosphor screen and the inside surface of the face plate, the coating having low reflectance and high transmission at the dominant wavelength of the phosphor, said angle sensitive interference coating having high transmittance for light emitted by the phosphor at near normal angles of incidence and high reflectance at high angles of incidence and creating a shift towards shorter wavelengths at high angles of incidence whereby light emitted at high angles of incidence by the phosphor is reflected to thereby suppress the outer ring-like portion of the halo.

2. A construction as in claim 1 wherein said coatings are comprised of a plurality of thin film layers of high and low index materials.

3. A construction as in claim 1 wherein said high angle of incidence is more than 45° from a line perpendicular to the face plate, said high transmittance $>80\%$ and said high reflectance $>50\%$.

4. A construction as in claim 2 in which the angle sensitive coating is composed of a silicon oxide for the low index material and a titanium oxide for the high index material.

5. In a method for suppressing the halo on a cathode ray tube having a face plate of clear glass with outside and inside surfaces and a fluorescent phosphor screen carried by the inside surface, suppressing the central portion of the halo by placing an anti-reflection coating on the outside surface and suppressing the outer ring-like portion of the halo by placing an angle sensitive coating on the inside surface to reflect light having a high angle of incidence emitted by the phosphor, said angle sensitive coating having low reflectance and high transmission at the dominant wavelength of the phosphor and creating a shift towards the shorter wavelengths at high angles of incidence whereby light emitted at high angles of incidence by the phosphor is reflected to thereby suppress the outer ring-like portion of the halo.

6. A method as in claim 5 together with the step of directing the reflected light back to the phosphor to increase the intensity of the display.

* * * * *